United States Patent [19]

Berta

[11] 4,351,538

[45] Sep. 28, 1982

[54] SPRING ASSISTED ROLLER SKATES

[76] Inventor: Sophia Berta, 224 Queensland Dr. SE., Calgary, Alberta, Canada

[21] Appl. No.: 140,216

[22] Filed: Apr. 14, 1980

[30] Foreign Application Priority Data

Feb. 5, 1980 [CA] Canada ..... 345048

[51] Int. Cl.[3] ..... A63C 17/02

[52] U.S. Cl. ..... 280/11.26; 272/70; 280/11.28

[58] Field of Search ..... 280/11.26, 11.27, 11.28, 280/11.14, 11.1 R, 11.115, 11.19, 11.23, 1.182; 272/96, 70, 114

[56] References Cited

U.S. PATENT DOCUMENTS

| | | | |
|---|---|---|---|
| 131,234 | 9/1872 | Todd | 280/11.19 |
| 200,186 | 2/1878 | Forsyth | 280/11.28 |
| 240,545 | 4/1881 | Raymond | 280/11.26 |
| 1,574,517 | 2/1926 | Rohdiek | 280/11.115 |
| 1,603,529 | 10/1929 | Faust | 280/11.28 X |
| 1,934,535 | 11/1933 | Hast | 280/11.26 |
| 2,232,195 | 2/1941 | Allred | 280/11.28 |
| 2,537,213 | 1/1951 | DeVault | 280/11.28 |
| 2,552,987 | 5/1951 | Loertz, Jr. | 280/11.28 |
| 2,553,450 | 6/1951 | Fuller | 280/11.28 |
| 2,557,331 | 6/1951 | Wintercorn | 280/11.28 |
| 2,651,527 | 9/1953 | Thoren | 280/1.182 |
| 2,676,812 | 4/1954 | Owsen et al. | 280/11.28 |
| 3,205,596 | 9/1965 | Hoffmaster | 272/70 |

FOREIGN PATENT DOCUMENTS

| | | | |
|---|---|---|---|
| 654100 | 12/1937 | Fed. Rep. of Germany | 280/11.28 |
| 849 | of 1875 | United Kingdom | 280/11.28 |
| 4882 | of 1910 | United Kingdom | 280/11.28 |

*Primary Examiner*—David M. Mitchell

*Attorney, Agent, or Firm*—William R. Hinds; George H. Dunsmuir

[57] ABSTRACT

A roller skate intended for jumping includes a two-piece plate of adjustable length for supporting the foot of a skater, a pair of arms pivotally connected to the bottom of the plate, including front arms inclined slightly forwardly and rear arms inclined slightly rearwardly, with rollers on the bottom ends of the arms, and helical springs connecting the back edges of the front arms and the front edges of the rear arms to the bottom center of the plate, so that downward pressure on the skate causes the arms to become more inclined and, when the springs pull the arms together to the less inclined positions, an upward impetus is given to the skater.

2 Claims, 3 Drawing Figures

SPRING ASSISTED ROLLER SKATES

BACKGROUND OF THE INVENTION

This invention relates to a roller skate, and in particular to a roller skate intended for jumping. The roller skate can be used for exercise and/or pleasure.

Spring type roller skates are disclosed in the patent art. Such skates are disclosed, for example in U.S. Pat. Nos. 200,186, issued to J. Forsyth on Feb. 12, 1878; 2,552,987, issued to F. Loertz, Jr. on May 15, 1951; 2,557,331, issued to A. Wintercorn on June 19, 1951; and 2,572,133, issued to T. C. Glenn on Oct. 23, 1951. Other spring mounted skates and skateboards are disclosed in U.S. Pat. Nos. 1,597,792, issued to E. A. Hoff et al on Aug. 31, 1926; 3,926,449, issued to S. O. E. Wilje on Dec. 16, 1975; and 4,115,565, issued to D. M. de Caussin et al on May 22, 1979.

In general, the springs employed in the inventions disclosed by the above mentioned Unites States Patents are intended to act as shock absorbers, i.e. to ensure a smooth ride. The Hoff et al patent discloses a skate intended for jumping; however, the spring mechanism employed in the skate relies on a somewhat complicated linkage.

The object of the present invention is to provide a relatively simple spring-type roller skate which facilitates jumping. The springs used in the skate of the present invention are primarily intended to enable or to aid jumping, and not as shock absorbers.

BRIEF SUMMARY OF THE INVENTION

Accordingly, the present invention relates to a roller skate comprising plate means for connecting the skate to the heel and toe ends of the foot of a user; first arm means inclined with respect to the vertical and extending downwardly and forwardly from the bottom of the tow end of said plate means; second arm means inclined with respect to the vertical and extending downwardly and rearwardly from the heel end of said plate means; means pivotally interconnecting the top end of each said arm means to said plate means for rotation around a horizontal axis; roller means on the bottom end of each said first and second arm means; first spring means interconnecting said plate means and first arm means, said first spring means extending from a point on said plate means intermediate the top ends of said first and second arm means to a point on the rear edge of said first arm means intermediate the ends thereof; and second spring means interconnecting said plate means and said second arms means, said second spring means extending from substantially the same point on said plate means as said first spring means to a point on the front edge of said second arm means intermediate the ends thereof, said spring means biasing said first and second arm means toward each other to less inclined positions, so that when the arms are inclined to a greater extent by downward forces during jumping, the springs facilitate jumping by tending to return the arm means to the original, less inclined positions.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENT(S)

Figure 1:
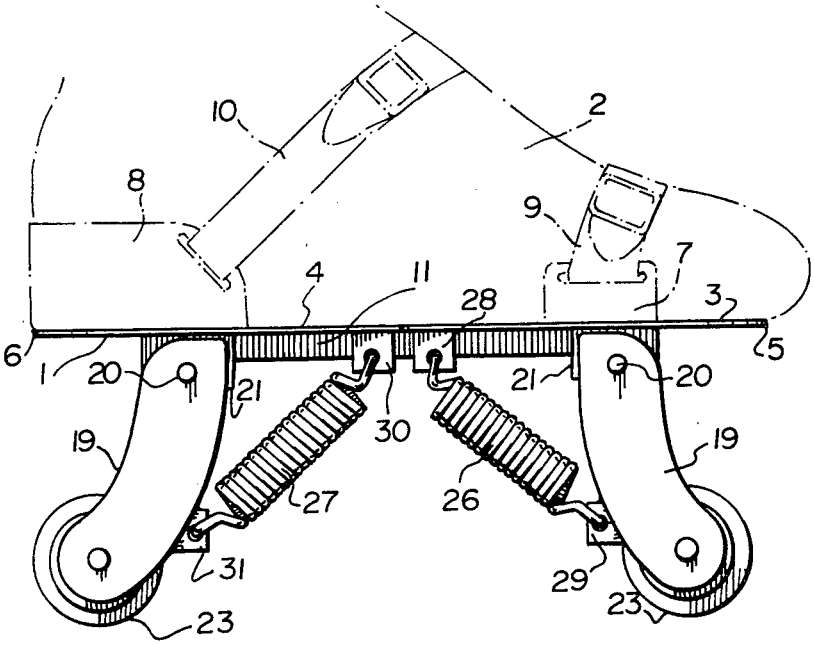
FIG. 1 is an elevation view of a roller skate in accordance with the present invention.
Figure 2:
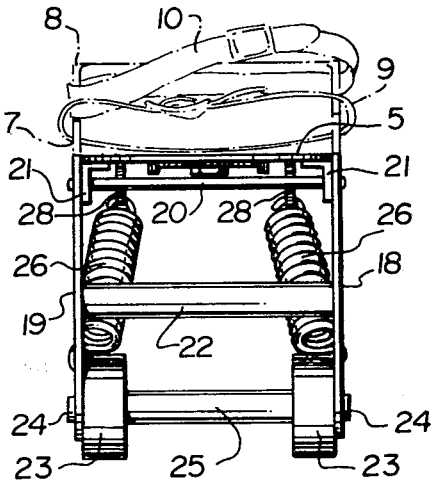
FIG. 2 is a front end view of the roller skate of FIG. 1.

With reference to the drawings, the roller skate of the present invention includes a top plate 1 for supporting a foot 2 of the user. The plate 1 is formed by front and rear metal panels 3 and 4, with convex outer ends 5 and 6, respectively. Toe and heel brackets 7 and 8, respectively extend upwardly from the plate 1 for receiving straps 9 and 10 for retaining the skate on the foot 2 of the user. The two panels 3 and 4 of the top plate are interconnected by a separate elongated, rectangular brace 11 with an inverted U-shaped cross-sectional configuration. The web 12 of the brace 11 is provided with a pair of longitudinally extending aligned slots 13 and 14 for receiving bolts 15, which project downwardly from the panels 3 and 4 of the top plate 1. Washers 16 and 17 are placed on the bolts 15 to hold the panels 3 and 4 and the brace 11 together. By loosening the nuts 17, the panels 3 and 4 can be slid together or apart to shorten or lengthen the skate.

A pair of arcuate arms 18 and 19 are provided at each of the front and rear ends of the plate 1. Each pair of arms 18 and 19 is pivotally mounted on a shaft 20 for rotation around the horizontal axis defined by the shaft. The shaft 20 extends between a pair of inverted L-shaped brackets 21 connected to the bases of the panels 3 and 4 at the toe and heel ends of the top plate. A reinforcing arm 22 extends between and is connected to the centres of the arms 18 and 19 for holding such arms a fixed distance apart. Wheels 23 are rotatably mounted on the ends of a shaft 24 extending between the bottom ends of each pair of arms 18 and 19. A spacer sleeve 25 is mounted on the shaft 24 between the wheels 23 for maintaining the wheels against the inner surfaces of the arms 18 and 19. Front and rear helical springs 26 and 27, respectively extend between each arm 18 and 19 and the bottom of the plate 1. The top end of each front spring 26 is connected to a lug 28 extending downwardly from a bottom rear corner of the panel 3. The bottom end of each front spring 26 is connected to a lug 29 on the lower rear edge of the front arms 18 and 19. The top end of each rear spring 27 is connected to a lug 30 extending downwardly from a bottom front corner of the panel 4, and bottom end of such spring is connected to a lug 31 on the lower front edge of the rear arms 18 and 19. As will become more apparent hereinafter, it is preferable to connect the springs 26 and 27 to the legs 18 and 19 below the longitudinal centres of the legs.

While the roller skate described hereinbefore is the old-fashioned type, which is secured to the shoe or boot of the user by straps, the skate could be the type with the arms and springs connected directly to the sole of the skate. In other words, the plate 1 would, in effect, be replaced by the sole of the skate boot, and the arms and springs would be connected to brackets or lugs extending downwardly from the bottom of the sole. In accordance with another embodiment of the invention, the two wheels or rollers at the front and rear of the skate could be replaced by one front and one rear wheel. With such a skate, a single central spring could be used for each of the front and rear wheels or two springs could be used with one on each side of an inverted U-shaped wheel or roller supporting bracket. Neither of the foregoing variations of the invention is illustrated, because they are obvious modifications of the basic invention, and with this disclosure could readily be constructed by the man skilled in the art to which the invention relates.

Figure 3:
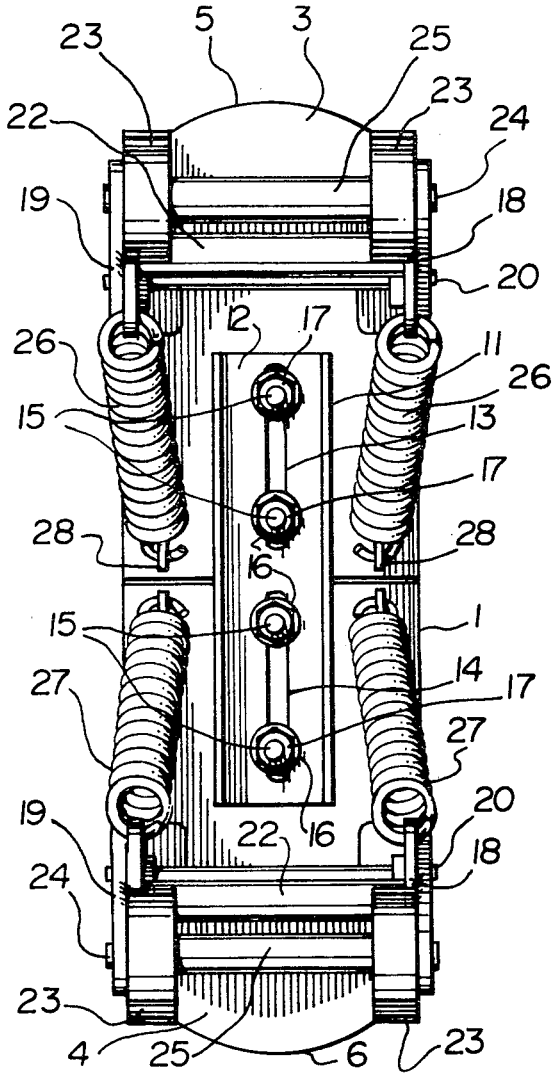
FIG. 3 is a bottom view of the roller skate of FIGS. 1 and 2.

In use, the springs 26 and 27 are sufficiently strong that even when a skater is standing on the skates, the arms 18 and 19 are maintained in the slightly inclined positions (FIGS. 1 and 3), i.e. the arms 18 and 19 are maintained in the initial or rest position during normal skating or standing on the skates. When the skater wishes to jump, he or she exerts a downward force on the skates and then jumps. When the downward force is exerted on the skates, the arms 18 and 19 pivot around the shafts 20 against the biases of the springs 26 and 27. Thus, the arms 18 and 19 become more inclined which stretches the helical springs 26 and 27, increasing the tension of such springs on the arms 18 and 19. As the skater enters the jump, the springs 26 and 27 draw the arms 18 and 19 to the more vertical or less inclined positions, imparting an upward impetus to the skater. As mentioned hereinbefore, the springs 26 and 27 are preferably connected to the arms 18 and 19 below the longitudinal centres thereof. The closer the spring connection to the bottom of the arms 18 and 19, the greater the force tending to return the arms to the rest or less inclined positions (FIG. 1) and the greater the jumping impetus.

Thus, there has been described a relatively simple roller skate of the type including springs and intended for jumping.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example equivalent elements may be substituted for those illustrated and described herein, parts may be used independently of the use of other features, all as will be apparent to one skilled in the art after having the benefits of the description of the invention.

What I claim is:

1. A roller skate comprising plate means for connecting the skate to the heel and toe ends of the foot of a user; first arm means comprising a pair of arms inclined with respect to the vertical and extending substantially downwardly and relatively slightly forwardly from the bottom of the toe end of said plate means; second arm means comprising a second pair of arms inclined with respect to the vertical and extending substantially downwardly and relatively slightly rearwardly from the heel end of said plate means; means pivotally interconnecting the top end of each said arm to said plate means for rotation around a horizontal axis; roller means on the bottom end of each of said arms; first tension spring means interconnecting said plate means and said first arm means, said first tension spring means extending from a point on said plate means intermediate the pivotally connected top ends of said first and second arm means to a point on the rear edge of said first arm means intermediate the ends thereof but substantially closer to the bottom end than the top end thereof; and second tension spring means interconnecting said plate means and said second arm means, said second tension spring means extending from substantially the same point on said plate means as said first spring means to a point on the front edge of said second arm means intermediate the ends thereof but substantially closer to the bottom end than the top end thereof, said tension spring means biasing said first and second arm means to said inclined positions such that said roller means are disposed relatively substantial distances below their respective arm pivot connections but relatively small distances respectively forwardly and rearwardly of their respective arm pivot connections, so that when the arms are pivoted away from each other and inclined to a greater extent by downward forces during jumping, the tension springs facilitate jumping by tending to return pivot the arm means toward each other to the original, less inclined positions, the areas below said plate means and respectively forward and rearward of said first and second arm means being free of obstructions in the pivot paths of the arm means so as to permit substantial pivotal movements of said arms respectively forwardly and rearwardly and upwardly against the bias of said spring means, and said first and second pairs of arms being arcuately curved so as to be concave forwardly and rearwardly, respectively wherein said plate means includes a front panel for supporting the toe end of a foot; a rear panel for supporting the heel end of a foot, and means extensibly interconnecting said front and rear panels, so that the length of the plates means can be adjusted to suit the foot of the user, said first and second tension spring means being connected to said front and rear panels, respectively.

2. A roller skate according to claim 1, wherein each of said first and second spring means is a helical tension spring connecting one said arm to the bottom of said plate means substantially at the longitudinal centre thereof.

* * * * *